US011800619B2

(12) United States Patent
Hasegawa et al.

(10) Patent No.: US 11,800,619 B2
(45) Date of Patent: Oct. 24, 2023

(54) TEST APPARATUS, TEST METHOD, AND COMPUTER-READABLE STORAGE MEDIUM

(71) Applicant: ADVANTEST CORPORATION, Tokyo (JP)

(72) Inventors: Kotaro Hasegawa, Saitama (JP); Kouji Miyauchi, Gunma (JP); Go Utamaru, Ibaraki (JP)

(73) Assignee: ADVANTEST CORPORATION, Tokyo (JP)

( * ) Notice: Subject to any disclaimer, the term of this patent is extended or adjusted under 35 U.S.C. 154(b) by 0 days.

(21) Appl. No.: 17/575,607

(22) Filed: Jan. 13, 2022

(65) Prior Publication Data

US 2022/0232685 A1 Jul. 21, 2022

(30) Foreign Application Priority Data

Jan. 21, 2021 (JP) ..... 2021-007928

(51) Int. Cl.
*H05B 45/20* (2020.01)
*G09G 3/32* (2016.01)
(Continued)

(52) U.S. Cl.
CPC ..... *H05B 45/50* (2020.01); *H05B 45/20* (2020.01); *H05B 45/34* (2020.01); *H05B 45/345* (2020.01)

(58) Field of Classification Search
CPC ..... H05B 45/20; H05B 45/34; H05B 45/345; H05B 45/50; G09G 3/006; G09G 3/32;
(Continued)

(56) References Cited

U.S. PATENT DOCUMENTS 5,990,692 A 11/1999 Jeong
6,377,300 B1 4/2002 Morris
(Continued)

FOREIGN PATENT DOCUMENTS

CN 1165401 A 11/1997
CN 101290340 A 10/2008
(Continued)

OTHER PUBLICATIONS

Office Action issued for counterpart Taiwanese Application No. 110148320, issued by the Taiwan Intellectual Property Office dated Sep. 6, 2022.
(Continued)

*Primary Examiner* — Jimmy T Vu

(57) ABSTRACT

A test apparatus includes: an electrical connection unit configured to be electrically connected to a light emitting device panel having a plurality of cells each including a light emitting device and arranged in a row direction and a column direction; a light source unit configured to collectively irradiate the plurality of cells with light; a reading unit configured to read, for each row of the light emitting device panel, a photoelectric signal obtained by photoelectrically converting the light in each of two or more of the cells arranged in the column direction by the light emitting device; a measuring unit configured to measure a photoelectric signal read from each of the plurality of cells; and a determination unit configured to determine a quality of each of the plurality of cells on a basis of a measurement result of the measuring unit.

14 Claims, 5 Drawing Sheets

(51) Int. Cl.
*H05B 45/50* (2022.01)
*H05B 45/345* (2020.01)
*H05B 45/34* (2020.01)

(58) Field of Classification Search
CPC ..... G09G 2300/06; G09G 2360/145; G01R 19/16528; G01R 19/003; G01R 31/2635; G01R 31/2825; G01R 31/2879
See application file for complete search history.

(56) References Cited

U.S. PATENT DOCUMENTS

| | | | |
|---|---|---|---|
| 2004/0173732 | A1 | 9/2004 | Rogers |
| 2004/0257358 | A1 | 12/2004 | Okamoto |
| 2005/0194990 | A1 | 9/2005 | Gothoskar |
| 2008/0218186 | A1 | 9/2008 | Kooiman |
| 2010/0053601 | A1 | 3/2010 | Osawa |
| 2010/0208261 | A1 | 8/2010 | Sens |
| 2012/0136470 | A1 | 5/2012 | Deans |
| 2012/0194211 | A1 | 8/2012 | Osawa |
| 2013/0015331 | A1 | 1/2013 | Birk |
| 2013/0021054 | A1 | 1/2013 | Voltan |
| 2013/0229188 | A1 | 9/2013 | Seymour |
| 2013/0328487 | A1 | 12/2013 | Yoshida |
| 2015/0015890 | A1 | 1/2015 | Zheng |
| 2015/0019168 | A1 | 1/2015 | Ohta |
| 2015/0253388 | A1 | 9/2015 | Masuda |
| 2016/0161418 | A1 | 6/2016 | Yeo |
| 2016/0306042 | A1 | 10/2016 | Schrank |
| 2016/0329864 | A1 | 11/2016 | Tu |
| 2017/0181384 | A1 | 6/2017 | Zhu |
| 2017/0208655 | A1 | 7/2017 | Lee |
| 2018/0254226 | A1 | 9/2018 | Iguchi |
| 2018/0276812 | A1 | 9/2018 | Kohyama |
| 2018/0352619 | A1 | 12/2018 | Weber |
| 2019/0004105 | A1 | 1/2019 | Henley |
| 2019/0204235 | A1 | 7/2019 | Nishizawa |
| 2019/0293570 | A1 | 9/2019 | Kobayashi |
| 2020/0111926 | A1 | 4/2020 | Shr |
| 2020/0174377 | A1 | 6/2020 | Osaka |
| 2020/0194616 | A1 | 6/2020 | Henley |
| 2020/0371152 | A1 | 11/2020 | Lin |
| 2020/0379029 | A1 | 12/2020 | Hasegawa |
| 2021/0050553 | A1 | 2/2021 | Ogawa |
| 2021/0270752 | A1 | 9/2021 | Suzuki |
| 2022/0178837 | A1 | 6/2022 | Nakamura |

FOREIGN PATENT DOCUMENTS

| | | | | |
|---|---|---|---|---|
| CN | 101583860 | A | 11/2009 | |
| CN | 102486520 | A | 6/2012 | |
| CN | 103364707 | A | 10/2013 | |
| CN | 105556949 | A * | 5/2016 | ..... A61B 6/42 |
| CN | 205844396 | U | 12/2016 | |
| CN | 103620294 | B | 2/2017 | |
| CN | 210690739 | U | 6/2020 | |
| CN | 112151426 | A | 12/2020 | |
| EP | 2439517 | A1 | 4/2012 | |
| JP | S50103270 | A | 8/1975 | |
| JP | S59230143 | A | 12/1984 | |
| JP | S6161478 | A | 3/1986 | |
| JP | S62283684 | A | 12/1987 | |
| JP | 2004266250 | A | 9/2004 | |
| JP | 2005032704 | A | 2/2005 | |
| JP | 2006098054 | A | 4/2006 | |
| JP | 2006215211 | A | 8/2006 | |
| JP | 2007528129 | A | 10/2007 | |
| JP | 2010230568 | A | 10/2010 | |
| JP | 2012084883 | A | 4/2012 | |
| JP | 2012527662 | A | 11/2012 | |
| JP | 2013113635 | A | 6/2013 | |
| JP | 2015119344 | A | 6/2015 | |
| JP | 2016173385 | A | 9/2016 | |
| JP | 2017504959 | A | 2/2017 | |
| JP | 6249513 | B1 | 12/2017 | |
| JP | 2017223969 | A | 12/2017 | |
| JP | 6462843 | B1 | 1/2019 | |
| JP | 6489421 | B2 | 3/2019 | |
| JP | 2019040192 | A | 3/2019 | |
| JP | 2019507953 | A | 3/2019 | |
| JP | 2019075434 | A | 5/2019 | |
| JP | 2020167433 | A | 10/2020 | |
| JP | 2020201086 | A | 12/2020 | |
| KR | 101112193 | B1 | 2/2012 | |
| KR | 20170085334 | A | 7/2017 | |
| TW | 200422597 | A | 11/2004 | |
| TW | 200730845 | A | 8/2007 | |
| TW | 200925565 | A | 6/2009 | |
| TW | 201243310 | A | 11/2012 | |
| TW | 201316013 | A | 4/2013 | |
| TW | 201350351 | A | 12/2013 | |
| TW | 201500750 | A | 1/2015 | |
| TW | 201528867 | A | 7/2015 | |
| TW | 201539005 | A | 10/2015 | |
| TW | 201712353 | A | 4/2017 | |
| TW | 201928307 | A | 7/2019 | |
| TW | 201938381 | A | 10/2019 | |
| TW | 202015329 | A | 4/2020 | |
| TW | 202023069 | A | 6/2020 | |
| TW | 202029369 | A | 8/2020 | |
| TW | 202036838 | A | 10/2020 | |
| TW | 202045944 | A | 12/2020 | |
| WO | 2008059767 | A1 | 5/2008 | |
| WO | 2015045222 | A1 | 4/2015 | |
| WO | 2015107656 | A1 | 7/2015 | |
| WO | 2016147266 | A1 | 9/2016 | |
| WO | 2018062633 | A1 | 4/2018 | |
| WO | 2018236767 | A2 | 12/2018 | |

OTHER PUBLICATIONS

Office Action issued for counterpart Taiwanese Application 109107015, issued by the Taiwan Intellectual Property Office dated Aug. 27, 2020.

Office Action issued for counterpart Taiwanese Application 109107015, issued by the Taiwan Intellectual Property Office dated Nov. 30, 2020.

Office Action issued for counterpart Korean Application10-2020-0025876, issued by the Korean Intellectual Property Office dated Jan. 7, 2021.

Notice of First Office Action for Patent Application No. 202010290804.5, issued by The National Intellectual Property Administration of the People's Republic of China dated Feb. 7, 2022.

Office Action issued for counterpart Taiwanese Application 110148320, issued by the Taiwan Intellectual Property Office dated Jan. 16, 2023.

Office Action issued for counterpart Taiwanese Application 110149281, issued by the Taiwan Intellectual Property Office dated Nov. 14, 2022.

Office Action issued for related Japanese Application No. 2019-103155, issued by the Japanese Patent Office dated Nov. 22, 2022 (drafted on Nov. 11, 2022).

Office Action issued for related Taiwanese Application 110148130, issued by the Taiwan Intellectual Property Office dated Jan. 7, 2023.

Office Action issued for related Japanese Application No. 2021-003813, issued by the Japanese Patent Office dated Jun. 20, 2023 (drafted on Jun. 15, 2023).

Office Action issued for related Taiwanese Application 112116170 issued by the Taiwan Intellectual Property Office dated Jul. 14, 2023.

Office Action issued for related Japanese Application No. 2021-145919, issued by the Japanese Patent Office dated Jul. 11, 2023 (drafted on Jul. 4, 2023).

Office Action issued for related Taiwanese Application 111128100, issued by the Taiwan Intellectual Property Office dated Apr. 13, 2023.

Office Action issued for related Japanese Application No. 2021-003813, transmitted from the Japanese Patent Office dated Aug. 8, 2023 (drafted on Aug. 1, 2023).

(56) References Cited

OTHER PUBLICATIONS

Office Action issued for counterpart Japanese Application No. 2021-007928, transmitted from the Japanese Patent Office dated Aug. 22, 2023 (drafted on Aug. 16, 2023).

* cited by examiner

TEST APPARATUS, TEST METHOD, AND COMPUTER-READABLE STORAGE MEDIUM

The contents of the following Japanese patent application(s) are incorporated herein by reference:

NO. 2021-007928 filed in JP on Jan. 21, 2021

BACKGROUND

1. Technical Field

The present invention relates to a test apparatus, a test method, and a computer-readable storage medium.

2. Related Art

A method is known in which one of a pair of LEDs to be inspected is caused to emit light and the other is caused to receive the light, and optical characteristics of the LED are inspected using a current value of a current output by a photoelectric effect (see, for example, Patent Documents 1 and 2).

CITATION LIST

Patent Document

Patent Document 1: Japanese translation publication of PCT route patent application No. 2019-507953

Patent Document 2: Japanese Patent Application Publication No. 2010-230568

DESCRIPTION OF EXEMPLARY EMBODIMENTS

Figure 1:
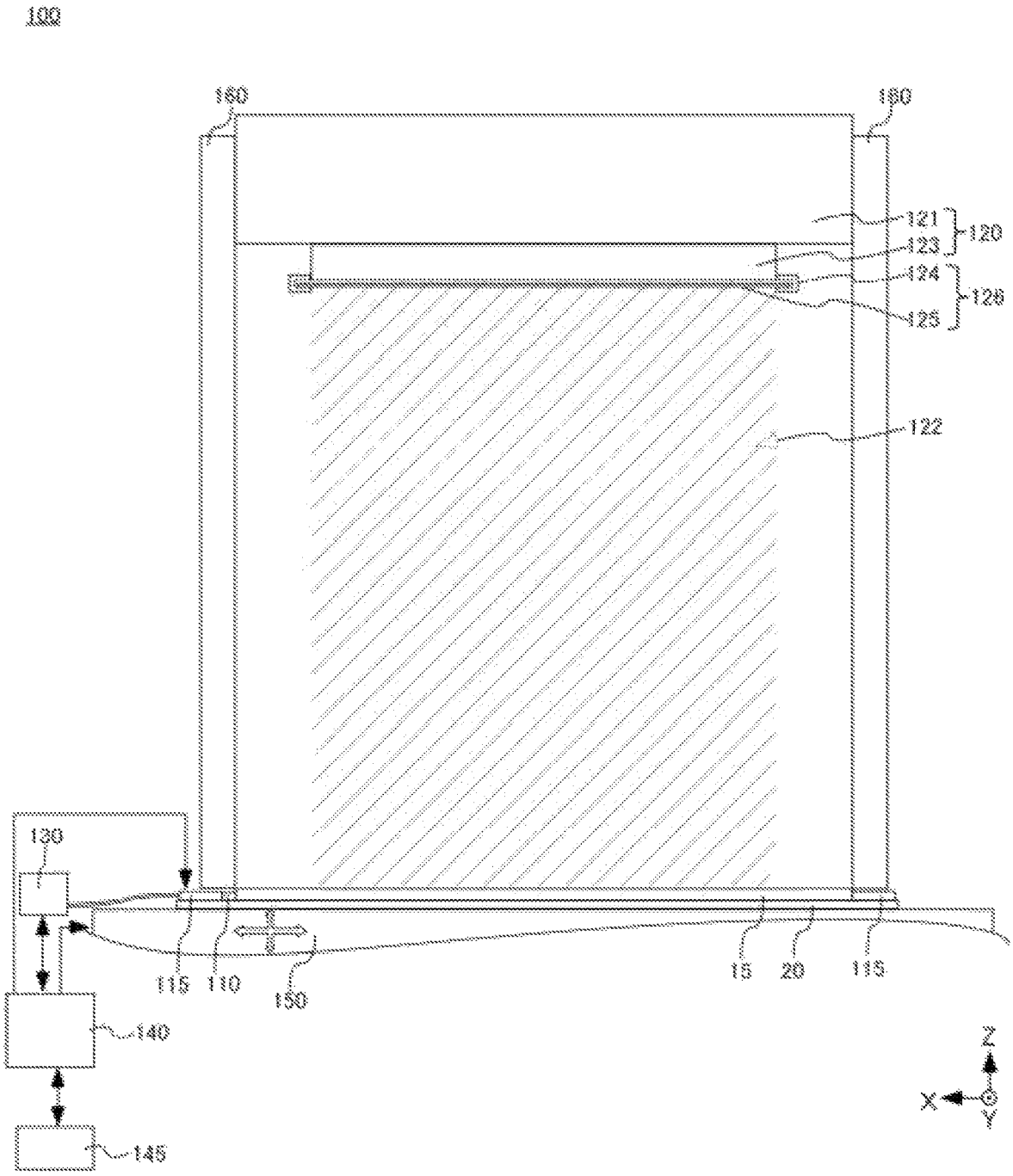
FIG. 1 is an example of an overall view illustrating an outline of a test apparatus 100 for testing an LED panel 15.

Hereinafter, the present invention will be described through embodiments of the invention, but the following embodiments do not limit the invention according to the claims. In addition, not all combinations of features described in the embodiments are essential to the solution of the invention. In the drawings, the same or similar parts are denoted by the same reference numerals, and redundant description may be omitted.

Figure 2:
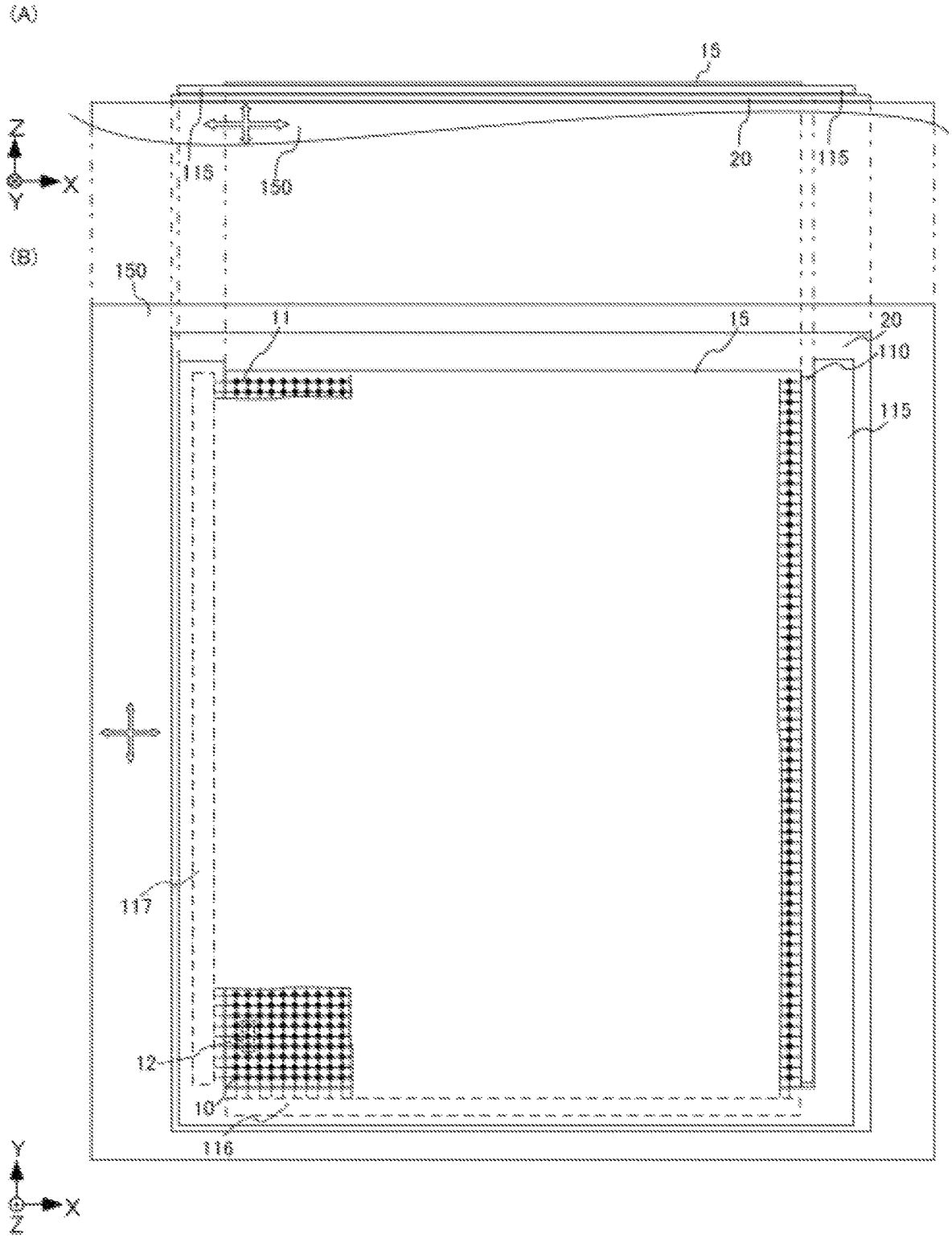
FIG. 2 is an example (A) of a side view and an example (B) of a plan view of the LED panel 15 in a state of being connected to the test apparatus 100.
Figure 3:
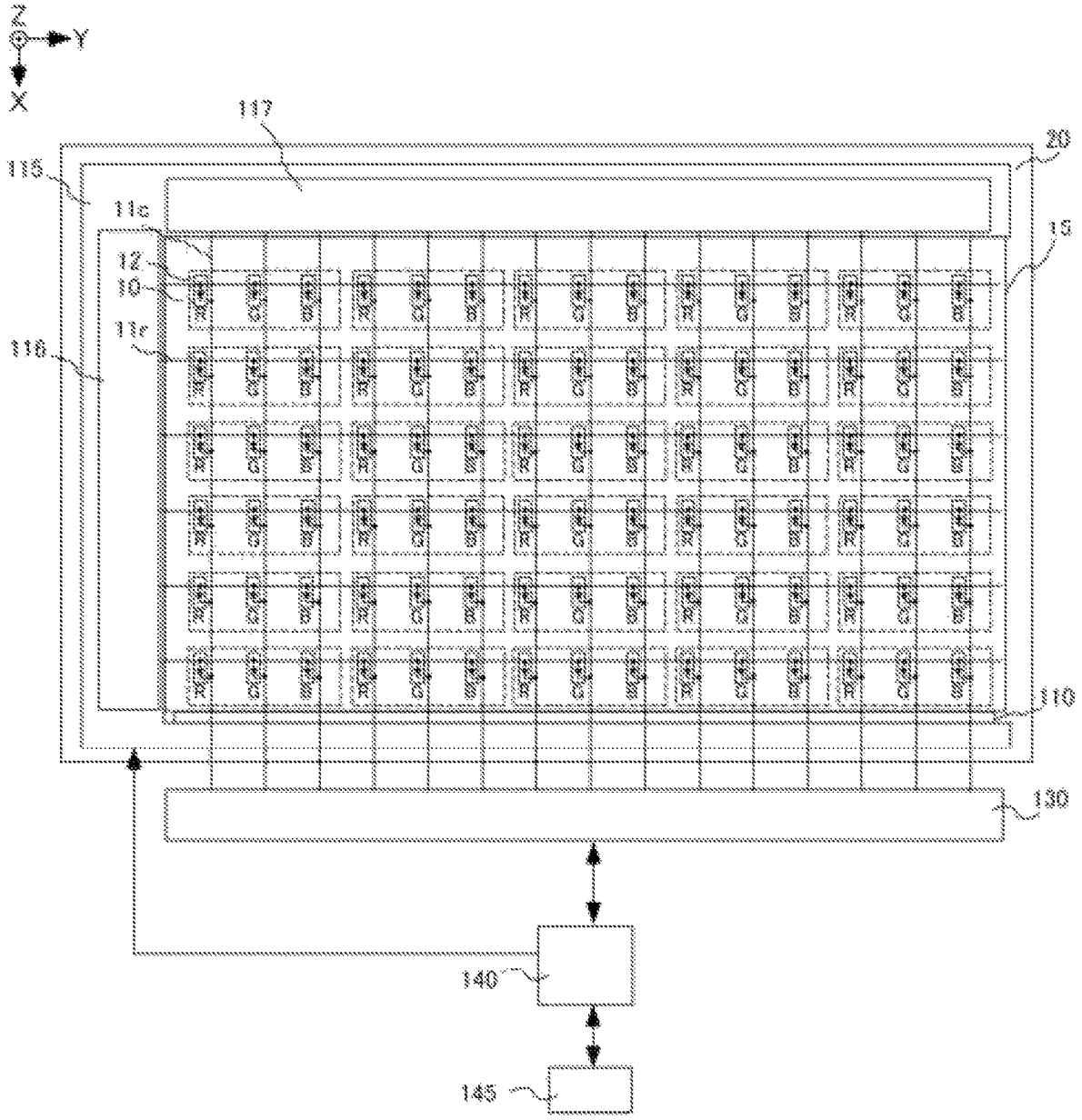
FIG. 3 is an example of an explanatory diagram for explaining a state in which the LED panel 15 is connected to the test apparatus 100.

FIG. 1 is an example of an overall view illustrating an outline of a test apparatus 100 for testing an LED panel 15. In addition, FIG. 2 is an example (A) of a side view and an example (B) of a plan view of the LED panel 15 in a state of being electrically connected to the test apparatus 100. In addition, FIG. 3 is an example of an explanatory diagram for explaining a state in which the LED panel 15 is connected to the test apparatus 100. Note that, in the specification of the present application, in a case where the term "being electrically connected" is defined, it is intended to be electrically connected by contact or to be electrically connected in a non-contact manner.

In FIG. 1, an X axis having a +X direction in the right-hand direction facing the paper surface, a Z axis having a +Z direction in the upper direction facing the paper surface, and a Y axis having a +Y direction in the front direction facing the paper surface are illustrated so as to be orthogonal to each other. Hereinafter, description may be made using these three axes.

As illustrated in FIG. 2, the LED panel 15 in the present embodiment includes a plurality of cells 12 formed in a panel (PLP) such as a glass base having a substantially rectangular outer shape provided with a wiring 11. The plurality of cells 12 are arranged in a row direction (X direction in the drawing) and a column direction (Y direction in the drawing) in the LED panel 15. Each cell 12 may correspond to a pixel of the LED panel 15. Note that, in FIG. 2, a part of the LED panel 15 is divided by wavy lines in order to illustrate some LEDs 10 and wirings 11 inside the LED panel 15. In addition, in FIG. 3, the LED 10 and the wiring 11 inside the LED panel 15 are illustrated in order to describe a state in which the LED panel 15 is connected to the test apparatus 100. Note that the configuration of the LEDs 10 and the like illustrated in FIG. 2 and FIG. 3 is merely an example, and other configurations and numbers may be used.

Each of the plurality of cells 12 includes one or two or more LEDs 10.

In the present embodiment, each cell 12 includes three LEDs 10 corresponding to three colors of RGB as an example, as indicated by a broken line frame in FIG. 2 and FIG. 3.

As an example, the LED panel 15 in the present embodiment is driven by passive matrix driving. As illustrated in FIG. 2, the plurality of LEDs 10 included in the LED panel 15 are arranged in the row direction and the column direction in a state of being electrically connected to each other by the wiring 11. As illustrated in FIG. 3, in each row, the anodes of the plurality of LEDs 10 arranged in the row direction are electrically connected to a row line 11*r* corresponding to the row. In each column, the cathodes of the plurality of LEDs 10 arranged in the column direction are electrically connected to a column line 11*c* corresponding to the column.

Here, in the present embodiment, in the plurality of cells 12 arranged in the column direction, a plurality of concolorous LEDs 10 that emit the same color with each other are mutually connected. In the plurality of cells 12 arranged in the column direction, red LEDs 10 are mutually connected by one column line 11*c*. Similarly, in the plurality of cells 12, green LEDs 10 are mutually connected by one column line 11*c*, and blue LEDs 10 are mutually connected by one column line 11*c*.

The LED 10 in the present embodiment is a micro LED having a dimension of 100 μm or less. Note that, instead of the micro LED, the LED 10 may be a mini LED having a dimension larger than 100 μm and equal to or less than 200 μm, an LED having a dimension larger than 200 μm, or another light emitting device such as an LD. For example, the LED panel 15 may be an organic display panel using an organic light emitting diode as each of the plurality of LEDs 10.

The test apparatus 100 uses the photoelectric effect of each LED 10 in the LED panel 15 to collectively test the optical characteristics of the plurality of cells 12 each including the LED 10 on the basis of a photoelectric signal output from the LED 10 that performs irradiation with light. The test apparatus 100 according to the present embodiment includes a substrate 20, an electrical connection unit 110, a light source unit 120, a temperature control unit 126, a reading unit 115, a measuring unit 130, a control unit 140, a storage unit 145, a placement unit 150, and a blocking unit 160.

The substrate 20 holds the LED panel 15. The substrate 20 is placed on the placement unit 150. Note that the test apparatus 100 may not include the substrate 20.

The electrical connection unit 110 is electrically connected to the LED panel 15. More specifically, the electrical connection unit 110 in the present embodiment is electrically connected to the column line 11*c* of each column. As illustrated in FIG. 3 as an example, the electrical connection unit 110 faces one side surface of the LED panel 15 in the substrate 20, and is electrically connected by being in contact with the terminal of each column line 11*c* in the one side surface of the LED panel 15. As a result, the electrical connection unit 110 is connected to one end of each column line 11*c* via the terminal, and is electrically connected to the plurality of LEDs 10.

The electrical connection unit 110 is also electrically connected to the measuring unit 130. As illustrated in FIG. 3, the electrical connection unit 110 is configured such that each of the plurality of column lines 11*c* is independently connected to the measuring unit 130 via the electrical connection unit 110.

The electrical connection unit 110 in the present embodiment is electrically connected by being in contact with the column line 11*c* connecting the plurality of LEDs 10, but may be electrically connected in a non-contact manner by, for example, electromagnetic induction or near field communication.

The light source unit 120 collectively irradiates the plurality of cells 12 with light. The light source unit 120 in the present embodiment irradiates the plurality of LEDs 10 of the plurality of cells 12 with light in a reaction wavelength band of the plurality of LEDs 10 of the plurality of cells 12. The light source unit 120 in the present embodiment includes a light source 121 and a lens unit 123.

The light source 121 emits light in the reaction wavelength band of the plurality of LEDs 10. The light source 121 may be, for example, a light source that emits light in a wide wavelength band, such as a xenon light source, or may be a light source that emits light in a narrow wavelength band, such as a laser light source. The light source 121 may include a plurality of laser light sources having wavelengths that are different from each other. Note that, in a case where the reaction wavelength and the light emission wavelength of the LED 10 are different from each other, even if the LED 10 is irradiated with light having the light emission wavelength of the LED 10, photoelectric conversion does not appropriately occur due to the difference.

The lens unit 123 includes one or more lenses, is provided adjacent to the irradiation unit of the light source 121, and converts the diffused light irradiated from the light source 121 into parallel light 122. In FIG. 1, the parallel light 122 is indicated by hatching. The projection plane of the parallel light 122 in the XY plane covers at least the plurality of cells 12 of the LED panel 15. In FIG. 2 and FIG. 3, illustration of the light source unit 120 is omitted.

The temperature control unit 126 suppresses temperature rise of the plurality of LEDs 10 due to irradiation with the light. The temperature control unit 126 in the present embodiment includes a temperature suppression filter 125 and a filter holding unit 124. The temperature suppression filter 125 has high light transmittance and absorbs a heat ray of incident light. The filter holding unit 124 is provided adjacent to the lens unit 123 and holds the temperature suppression filter 125. Note that the temperature control unit 126 may further include a cooler that cools the heat absorbed by the temperature suppression filter 125.

In order to keep the temperatures of the plurality of LEDs 10 constant, the temperature control unit 126 may include, instead of or in addition to the above configuration, a temperature applying apparatus that adjusts the temperatures of the plurality of LEDs 10, an air blowing mechanism that blows air toward the plurality of LEDs 10, and the like. In a case where the air blowing mechanism is used, the temperature control unit 126 may further include a static electricity removing unit that prevents the plurality of LEDs 10 from being charged with static electricity when air is blown by the air blowing mechanism. The static electricity removing unit may be, for example, an ionizer. The above described temperature applying apparatus may be provided in the substrate 20 or the like in a manner contacting the LED panel 15. In addition, the above described air blowing mechanism may be provided on the side of the placement unit 150 in a manner not contacting the LED panel 15. Note that the test apparatus 100 may not include the temperature control unit 126. In FIG. 2 and FIG. 3, illustration of the temperature control unit 126 is omitted.

The reading unit 115 in the present embodiment includes a row drive unit 116 and a column drive unit 117. The row drive unit 116 is electrically connected to the anode of the LED 10 via the row line 11*r*, and the column drive unit 117 is electrically connected to the cathode of the LED 10 via the column line 11*c*.

The reading unit 115 reads, for each row of the LED panel 15, a photoelectric signal obtained by photoelectrically converting light by the LED 10 in each of the two or more cells 12 arranged in the column direction. The reading unit 115 in the present embodiment applies, to one row line 11*r* connected to three LEDs 10 of the cell 12 from which the photoelectric signal is to be read, a positive reference voltage higher than the potentials of the three column lines 11*c* connected to the three LEDs 10, for example, a ground potential, thereby reading the photoelectric signal output by the three LEDs 10 after photoelectric conversion of light. Note that, as illustrated in FIG. 3, a plurality of other cells 12 are also connected to the row line 11*r*.

While the LED panel 15 is irradiated with light, the reading unit 115 in the present embodiment reads the photoelectric signal from each of the two or more cells 12 arranged in the column direction. As an example, while the light source 121 collectively irradiates the plurality of cells 12 of the LED panel 15 with light, the reading unit 115 sequentially applies the reference voltage to each of the plurality of row lines 11*r* from the negative side of the Y axis to the positive side of the Y axis in FIG. 3, thereby reading the photoelectric signal from each of the plurality of cells 12 arranged in the column direction. In the present embodiment, the photoelectric signal flowing from each LED 10 to the column line 11*c* is supplied to the measuring unit 130 via the electrical connection unit 110. Note that, in FIG. 2, a part of the reading unit 115 is divided by a wavy line in order to illustrate the wiring 11 inside the reading unit 115.

The measuring unit 130 measures the photoelectric signal read from each of the plurality of cells 12 and supplied via the electrical connection unit 110. As illustrated in FIG. 3, the measuring unit 130 in the present embodiment is connected to each of the plurality of column lines 11*c* via the electrical connection unit 110, and individually measures the current value of the current supplied from each column line 11*c*. Note that the measuring unit 130 may measure a voltage value corresponding to the current value instead of the current value. In FIG. 2, illustration of the measuring unit 130 is omitted.

The control unit 140 controls each component of the test apparatus 100.

The control unit 140 in the present embodiment controls the light source 121 of the light source unit 120, thereby controlling the irradiation time, wavelength, and intensity of the parallel light 122 with which the plurality of cells 12 are collectively irradiated. The control unit 140 in the present embodiment also drives the placement unit 150 such that at least the plurality of cells 12 of the LED panel 15 placed on the placement unit 150 via the substrate 20 can receive light from the light source unit 120 in the blocking unit 160 by controlling the placement unit 150. Note that the control unit 140 may grasp the position coordinates in the space of the blocking unit 160 and the relative position between the blocking unit 160 and the LED panel 15 on the placement unit 150 by referring to reference data in the storage unit 145.

The control unit 140 further controls the reading unit 115 to read the photoelectric signal from each of the two or more cells 12 arranged in the column direction for each row of the LED panel 15. The control unit 140 also supplies a voltage used to drive the row drive unit 116 and the column drive unit 117 of the reading unit 115.

The control unit 140 further determines the quality of each of the plurality of cells 12 on the basis of the measurement result of the measuring unit 130. More specifically, the control unit 140 in the present embodiment determines at least one cell 12 including at least one LED 10 in which the measured photoelectric signal is out of the normal range among the plurality of cells 12 as defective. The control unit 140 refers to the storage unit 145 to perform sequence control of a plurality of configurations in the test apparatus 100 described above. Note that the control unit 140 functions as an example of a determination unit. In FIG. 2, illustration of the control unit 140 is omitted.

The storage unit 145 stores a measurement result, reference data for determining the quality of each of the plurality of cells 12, a determination result, reference data for moving the placement unit 150, a sequence and a program for controlling each component in the test apparatus 100, and the like. The storage unit 145 is referred to by the control unit 140. In FIG. 2, illustration of the storage unit 145 is omitted.

The substrate 20 holding the LED panel 15 is placed in the placement unit 150. The placement unit 150 in the illustrated example has a substantially rectangular outer shape in a plan view, but may have another outer shape. The placement unit 150 has a function of holding a vacuum chuck, an electrostatic chuck, or the like, and holds the placed substrate 20. In addition, the placement unit 150 moves two-dimensionally in the XY plane and moves up and down in the Z axis direction by being driven and controlled by the control unit 140. In FIG. 1 and FIG. 2(A), illustration of the placement unit 150 on the negative direction side of the Z axis is omitted. In addition, in FIG. 1 and FIG. 2, the moving direction of the placement unit 150 is indicated by a white arrow. The same applies to the following drawings. Note that the test apparatus 100 may not include the placement unit 150. In FIG. 3, illustration of the placement unit 150 is omitted.

The blocking unit 160 blocks light other than the light from the light source unit 120. The surface of the blocking unit 160 in the present embodiment is entirely painted black to prevent irregular reflection of light on the surface. In addition, as illustrated in FIG. 1, the blocking unit 160 in the present embodiment is provided so as to be in close contact with each of the outer periphery of the light source 121 and the outer periphery of the LED panel 15, and this configuration blocks light other than the light from the light source unit 120. Note that the test apparatus 100 may not include the blocking unit 160. In FIG. 2 and FIG. 3, illustration of the blocking unit 160 is omitted.

Figure 4:
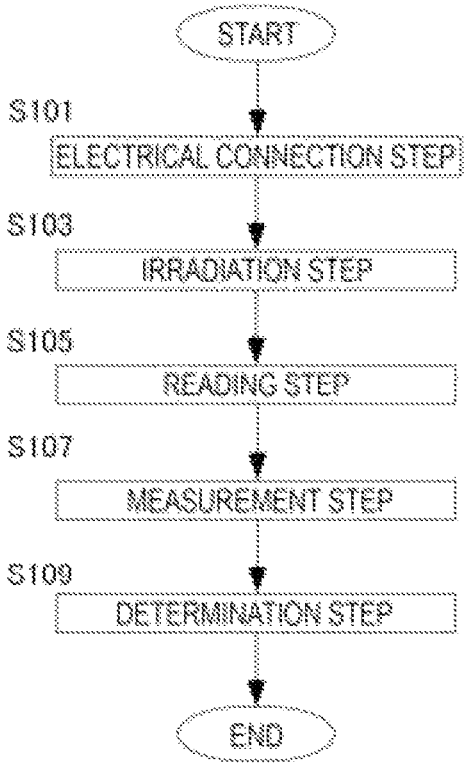
FIG. 4 is an example of a flowchart illustrating a flow of a test method by the test apparatus 100.

FIG. 4 is an example of a flowchart for explaining a flow of a test method by the test apparatus 100. The flow is started when, for example, a user inputs to the test apparatus 100 to start a test of the LED panel 15 with the substrate 20 holding the LED panel 15 placed on the placement unit 150.

The test apparatus 100 executes an electrical connection step of electrically connecting the electrical connection unit 110 to the LED panel 15 (Step S101). As a specific example, the test apparatus 100 may output a command to a conveyance apparatus or the like that conveys the LED panel 15 to dispose the LED panel 15 on the substrate 20 so that the LED panel 15 is connected to the reading unit 115 and the electrical connection unit 110 on the substrate 20.

The test apparatus 100 executes an irradiation step of collectively irradiating the plurality of cells 12 with light (Step S103). As a specific example, the control unit 140 outputs a command to the placement unit 150, moves the placement unit 150 so that the LED panel 15 is in close contact with the blocking unit 160, and further outputs a command to the light source unit 120 to irradiate the plurality of cells 12 of the LED panel 15 with the parallel light 122. Note that, in the present embodiment, all the LEDs 10 included in the plurality of cells 12 of the LED panel 15 are collectively irradiated with the parallel light 122, but instead of this, some of the LEDs 10 may be sequentially irradiated with the parallel light 10.

The test apparatus 100 executes, for each row of the LED panel 15, a reading step of reading a photoelectric signal in which light is photoelectrically converted by the LED 10 in each of the two or more cells 12 arranged in the column direction (Step S105). As a specific example, while the light source 121 collectively irradiates the plurality of cells 12 of the LED panel 15 with light by issuing a command to the reading unit 115, the control unit 140 sequentially reads the photoelectric signal output to each column line 11*c* from each of the plurality of cells 12 arranged in the column direction by setting the row line 11*r* corresponding to the row to be read as a reference voltage and setting the row lines 11*r* corresponding to the rows other than the row to be read as a voltage equal to or lower than the potential of the column line 11*c* for each row. The reference voltage is a positive voltage higher than the potential of the column line 11*c* to which the cell 12 from which the photoelectric signal is to be read is connected, for example, the ground potential. In a case where the column line 11*c* is at the ground potential, the row lines 11*r* corresponding to the rows other than the row to be read may be set to the ground potential or the negative voltage.

The test apparatus 100 executes a measurement step of measuring the photoelectric signal read from each of the plurality of cells 12 via the electrical connection unit 110 (Step S107). As a specific example, the control unit 140 issues a command to the measuring unit 130, causes the current value of the current individually supplied from each column line 11*c* via the electrical connection unit 110 to be measured for each row, and causes the control unit 140 to output the measurement result for each cell 12 including the plurality of LEDs 10. The control unit 140 stores each measurement result of the plurality of cells 12 in the storage unit 145. Note that, for each row, the measuring unit 130 may individually measure the current value of the current individually supplied from each column line 11*c* while sequentially switching each column, or may measure the current value in units of cells 12. In the case of measuring in units of cells 12, for example, the current values of the currents supplied from three adjacent column lines 11*c* to which three adjacent LEDs 10 emitting respective colors of RGB included in the cell 12 are connected may be collectively measured.

The test apparatus 100 executes a determination step of determining the quality of each of the plurality of cells 12 on the basis of the measurement result of the above described measurement step (Step S109), and the flow ends. As a specific example, in a case where the measurement results of all the cells 12 of the LED panel 15 are stored with reference to the measurement results of the storage unit 145 and the reference data, the control unit 140 determines the quality of each of the plurality of cells 12 on the basis of the measurement results.

As described above, the control unit 140 in the present embodiment determines at least one cell 12 including at least one LED 10, among the plurality of cells 12, in which the measured photoelectric signal is out of the normal range, as defective. The control unit 140 may use, as the normal range, a range based on the statistic corresponding to the photoelectric signal output by each of the plurality of LEDs 10. As an example of the statistic, a range within the average value $\pm 1\sigma$, a range within the average value $\pm 2\sigma$, or a range within the average value $\pm 3\sigma$ of the photoelectric signal may be used.

More specifically, the control unit 140 may use different normal ranges for the respective emission colors of the LEDs 10. The control unit 140 may further use an average current amount and a standard deviation of the photoelectric signals measured for the plurality of concolorous LEDs 10 connected to each other by each column line 11*c*.

In this case, the control unit 140 calculates the average value and the standard deviation $\sigma$ on the basis of the current value of the current flowing from the concolorous LEDs 10 for each column line 11*c*, which is stored in the storage unit 145, or on the basis of the current values measured for the plurality of column lines 11*c* to which the concolorous LEDs 10 are connected. In addition, in a case where there are a plurality of peaks in the current values, the statistic of the current values may be calculated using statistical processing capable of corresponding to the plurality of peaks without using the standard deviation.

In addition to the statistical processing using the average and the standard deviation, any statistical processing may be used. For example, in order to cope with a case where there are a plurality of peaks or a case where the peaks are biased in the statistical value of the photoelectric signal, a mathematical formula of the standard deviation may be made different, other algorithms or a combination of algorithms may be adopted, and these may be used depending on the characteristics of the LED 10. An example of another algorithm may be Good Die Bad Neighborhood (GDNB), cluster detection, or the like.

Note that, instead of the average current value and the standard deviation described above, the control unit 140 may use the average current amount and the standard deviation of the photoelectric signal measured for each of the plurality of concolorous units obtained by dividing, into two or more LEDs 10, the plurality of concolorous LEDs 10 connected to each other.

The control unit 140 may determine the selected LED 10 as defective in a case where the luminance of the light emitted by the selected LED 10 is out of the normal range. The control unit 140 may use, as the normal range, a range based on a statistic corresponding to the luminance of the light emitted by at least one LED 10 to be subjected to light emission processing.

As a comparative example with the test method by the test apparatus 100 of the present embodiment, for example, a test method of optical characteristics of LEDs is conceivable, in which a plurality of LEDs arranged on a wafer are sequentially turned on one by one, and light is received by an image sensor, a spectral luminance meter, or the like to determine whether light is correctly emitted.

In a case where the optical characteristics of the plurality of LEDs described above are collectively measured using the test method of the comparative example, light emitted from each of the plurality of adjacent LEDs interferes with each other, a defective LED having a relatively deteriorated optical characteristic cannot be correctly identified, and an image sensor or the like becomes very expensive for performing image recognition in a wide range with high accuracy. In particular, in a case where a plurality of micro LEDs are tested, the problem becomes remarkable.

On the other hand, according to the test apparatus 100 of the present embodiment, the electrical connection unit 110 is electrically connected to the LED panel 15, the plurality of cells 12 included in the LED panel 15 is collectively irradiated with light, and for each row of the LED panel 15, the photoelectric signal in which the light is photoelectrically converted by the LED 10 in each of the two or more cells 12 arranged in the column direction is read. The test apparatus 100 further measures the photoelectric signal read from each of the plurality of cells 12, and determines the quality of each of the plurality of cells 12 on the basis of the measurement result. As a result, the test apparatus 100 can not only shorten the processing time by simultaneously measuring the photoelectric signals of the plurality of cells 12, but also can correctly identify a defective cell 12 having deteriorated optical characteristics by determining the quality of the cell 12 using the measured photoelectric signals without being affected by the measurement of the optical characteristics of the other cells 12. In addition, according to the test apparatus 100, the number of cells 12 to be simultaneously measured can be easily expanded.

According to the test apparatus 100 of the present embodiment, for the other configurations except for the light source unit 120, the temperature control unit 126, the reading unit 115, the substrate 20, and the blocking unit 160, that is, for the electrical connection unit 110, the measuring unit 130, the control unit 140, the storage unit 145, and the placement unit 150, those used for testing devices other than optical devices such as the LED panel 15 can be used.

Various embodiments of the present invention may also be described with reference to flowcharts and block diagrams, where the blocks may represent (1) a step of processing in which an operation is executed or (2) a section of an apparatus that is responsible for executing the operation. Certain steps and sections may be implemented by dedicated circuitry, programmable circuitry provided with computer-readable instructions stored on a computer-readable medium, and/or a processor provided with computer-readable instructions stored on a computer-readable medium. The dedicated circuitry may include digital and/or analog hardware circuits, and may include integrated circuits (ICs) and/or discrete circuits. The programmable circuitry may include reconfigurable hardware circuits including memory elements such as logic AND, logic OR, logic XOR, logic NAND, logic NOR, and other logic operations, flip-flops, registers, field programmable gate arrays (FPGA), programmable logic arrays (PLA), and the like.

The computer-readable medium may include any tangible device capable of storing instructions to be executed by a suitable device, so that the computer-readable medium having the instructions stored therein will have a product including instructions that can be executed to create means for executing the operations specified in flowcharts or block diagrams. Examples of the computer-readable medium may include an electronic storage medium, a magnetic storage medium, an optical storage medium, an electromagnetic storage medium, a semiconductor storage medium, and the like. More specific examples of the computer-readable medium may include a floppy (registered trademark) disk, a diskette, a hard disk, a random access memory (RAM), a read-only memory (ROM), an erasable programmable read-only memory (EPROM or flash memory), an electrically erasable programmable read-only memory (EEPROM), a static random access memory (SRAM), a compact disc read-only memory (CD-ROM), a digital versatile disk (DVD), a Blu-ray (registered trademark) disk, a memory stick, an integrated circuit card, and the like.

The computer-readable instructions may include source code or object code written in any combination of one or more programming languages, including assembler instructions, instruction-set-architecture (ISA) instructions, machine instructions, machine-dependent instructions, microcode, firmware instructions, state-setting data, or an object oriented programming language such as Smalltalk (registered trademark), JAVA (registered trademark), C++, or the like, and conventional procedural programming languages such as the "C" programming language or similar programming languages.

The computer-readable instructions may be provided for a processor or programmable circuitry of a general purpose computer, special purpose computer, or other programmable data processing apparatuses locally or via a wide area network (WAN) such as a local area network (LAN), the Internet, or the like, and execute the computer-readable instructions to create means for executing the operations specified in flowcharts or block diagrams. Examples of the processor include a computer processor, a processing unit, a microprocessor, a digital signal processor, a controller, a microcontroller, and the like.

Figure 5:
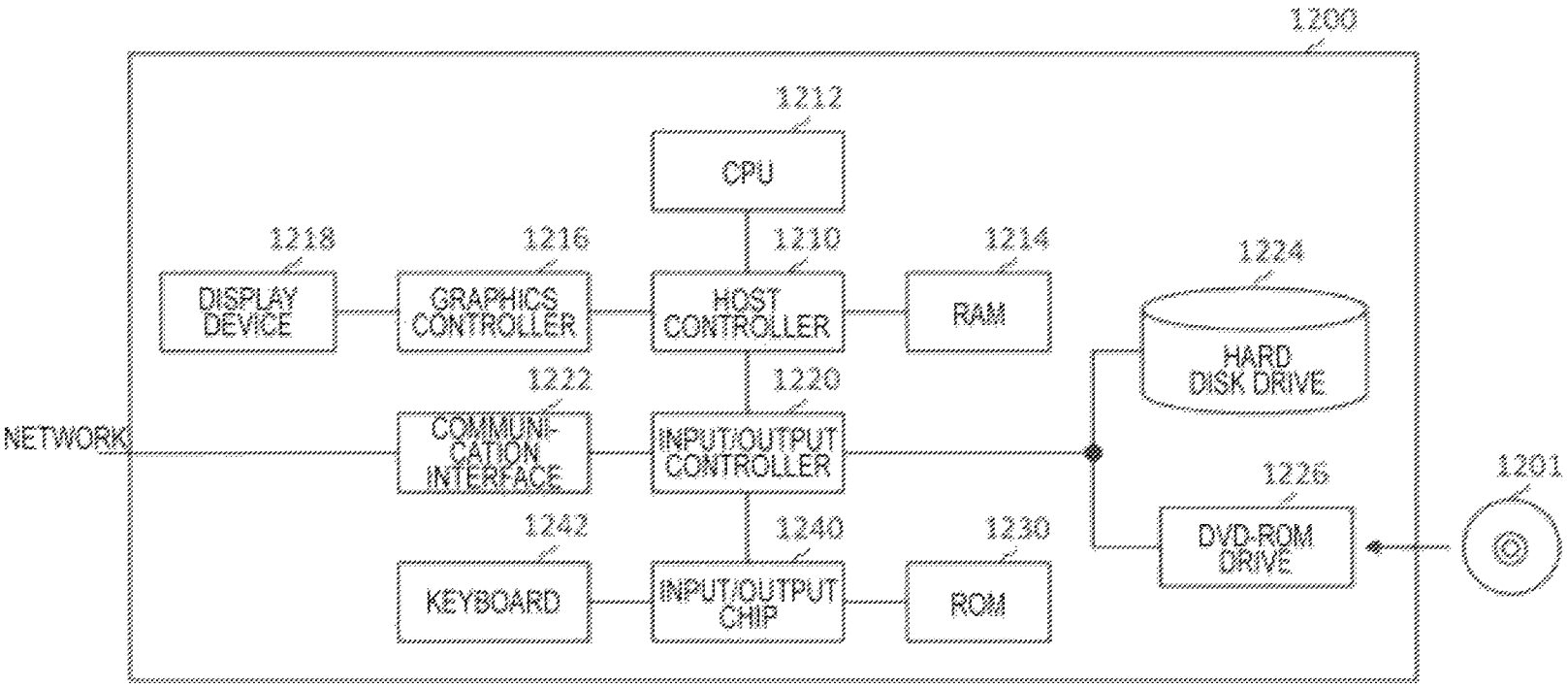
FIG. 5 is a diagram illustrating an example of a computer 1200 in which a plurality of aspects of the present invention may be embodied in whole or in part.

FIG. 5 illustrates an example of a computer 1200 in which a plurality of aspects of the present invention may be fully or partially embodied. A program installed in the computer 1200 can cause the computer 1200 to function as an operation associated with the apparatus according to the embodiment of the present invention or one or more "units" of the apparatus, or execute the operation or the one or more "units", and/or cause the computer 1200 to execute a process according to the embodiment of the present invention or a step of the processing. Such programs may be executed by a CPU 1212 to cause the computer 1200 to execute certain operations associated with some or all of the blocks in the flowcharts and block diagrams described in the present specification.

The computer 1200 according to the present embodiment includes the CPU 1212, a RAM 1214, a graphic controller 1216, and a display device 1218, which are interconnected by a host controller 1210. The computer 1200 also includes input/output units such as a communication interface 1222, a hard disk drive 1224, a DVD-ROM drive 1226, and an IC card drive, which are connected to the host controller 1210 via an input/output controller 1220. The computer also includes legacy input/output units such as a ROM 1230 and a keyboard 1242, which are connected to the input/output controller 1220 via an input/output chip 1240.

The CPU 1212 operates according to programs stored in the ROM 1230 and the RAM 1214, thereby controlling each unit. The graphics controller 1216 acquires image data generated by the CPU 1212 in a frame buffer or the like provided in the RAM 1214 or in the graphics controller 1216 itself, such that the image data is displayed on the display device 1218.

The communications interface 1222 communicates with other electronic devices via a network. The hard disk drive 1224 stores programs and data used by the CPU 1212 in the computer 1200. The DVD-ROM drive 1226 reads program or data from the DVD-ROM 1201 and provides the programs or data to the hard disk drive 1224 via the RAM 1214. The IC card drive reads programs and data from the IC card and/or writes the programs and data to the IC card.

The ROM 1230 stores a boot program and the like, therein, executed by the computer 1200 at the time of activation and/or a program depending on hardware of the computer 1200. The input/output chip 1240 may also connect various input/output units to the input/output controller 1220 via a parallel port, a serial port, a keyboard port, a mouse port, or the like.

The program is provided by a computer-readable storage medium such as a DVD-ROM 1201 or an IC card. The program is read from a computer-readable storage medium, installed in the hard disk drive 1224, the RAM 1214, or the ROM 1230 that are also examples of the computer-readable storage medium, and executed by the CPU 1212. The information processing described in these programs is read by the computer 1200 and provides cooperation between the programs and various types of hardware resources described above. The apparatus or method may be configured by implementing operation or processing of information according to the use of the computer 1200.

For example, in a case where communication is executed between the computer 1200 and an external device, the CPU 1212 may execute a communication program loaded in the RAM 1214 and instruct the communication interface 1222 to execute communication processing on the basis of a process described in the communication program. Under the control of the CPU 1212, the communication interface 1222 reads transmission data stored in a transmission buffer area provided in a recording medium such as the RAM 1214, the hard disk drive 1224, the DVD-ROM 1201, or the IC card, transmits the read transmission data to the network, or writes reception data received from the network in a reception buffer area or the like provided on the recording medium.

In addition, the CPU 1212 may cause the RAM 1214 to read all or a necessary part of a file or database stored in an external recording medium such as the hard disk drive 1224, the DVD-ROM drive 1226 (DVD-ROM 1201), the IC card, or the like, and may execute various types of processing on data on the RAM 1214. Next, the CPU 1212 may write back the processed data to the external recording medium.

Various types of information such as various types of programs, data, tables, and databases may be stored in a recording medium in order to be subjected to information processing. The CPU 1212 may execute various types of processing on the data read from the RAM 1214, including various types of operations, information processing, conditional determination, conditional branching, unconditional branching, information retrieval/replacement, and the like, which are described throughout the present disclosure and specified by a command sequence of a program, and writes back the results to the RAM 1214. In addition, the CPU 1212 may retrieve information in a file, a database, or the like in the recording medium. For example, in a case where a plurality of entries each having the attribute value of a first attribute associated with the attribute value of a second attribute is stored in the recording medium, the CPU 1212 may retrieve an entry matching the condition in which the attribute value of the first attribute is specified from among the plurality of entries, read the attribute value of the second attribute stored in the entry, and thereby acquire the attribute value of the second attribute associated with the first attribute satisfying the predetermined condition.

The programs or software modules according to the above description may be stored in a computer-readable storage medium on or near the computer 1200. In addition, a recording medium such as a hard disk or a RAM provided in a server system connected to a dedicated communication network or the Internet can be used as a computer-readable storage medium, thereby providing a program to the computer 1200 via the network.

While the embodiments of the present invention have been described, the technical scope of the invention is not limited to the above described embodiments. It is apparent to persons skilled in the art that various alterations and improvements can be added to the above-described embodiments. In addition, the matters described for a specific embodiment can be applied to other embodiments within a scope not technically contradictory. In addition, each component may have a similar feature to other component having the same name and different reference signs. It is also apparent from the scope of the claims that the embodiments added with such alterations or improvements can be included in the technical scope of the invention.

The operations, procedures, steps, and stages of each process performed by an apparatus, system, program, and method shown in the claims, embodiments, or diagrams can be performed in any order as long as the order is not indicated by "prior to," "before," or the like and as long as the output from a previous process is not used in a later process. Even if the process flow is described using phrases such as "first" or "next" in the claims, embodiments, or diagrams, it does not necessarily mean that the process must be performed in this order.

EXPLANATION OF REFERENCES

10: LED
11: wiring
11*r*: row line
11*c*: column line
12: cell
15: LED panel
20: substrate
100: test apparatus
110: electrical connection unit
115: reading unit
116: row drive unit
117: column drive unit
120: light source unit
121: light source
122: parallel light
123: lens unit
124: filter holding unit
125: temperature suppression filter
126: temperature control unit
130: measuring unit
140: control unit
145: storage unit
150: placement unit
160: blocking unit
1200: computer
1201: DVD-ROM
1210: host controller
1212: CPU
1214: RAM
1216: graphics controller
1218: display device
1220: input/output controller
1222: communication interface
1224: hard disk drive
1226: DVD-ROM drive
1230: ROM
1240: input/output chip
1242: keyboard

What is claimed is:

1. A test apparatus comprising:

an electrical connection unit configured to be electrically connected to a light emitting device panel having a plurality of cells each including a light emitting device and arranged in a row direction and a column direction;

a light source unit configured to collectively irradiate the plurality of cells with light;

a reading unit configured to read, for each row of the light emitting device panel, a photoelectric signal obtained by photoelectrically converting the light in each of two or more of the cells arranged in the column direction by the light emitting device;

a measuring unit configured to measure a photoelectric signal read from each of the plurality of cells; and a determination unit configured to determine a quality of each of the plurality of cells on a basis of a measurement result of the measuring unit.

2. The test apparatus according to claim 1, wherein the reading unit is configured to read a photoelectric signal from each of the two or more cells arranged in the column direction while the light emitting device panel is irradiated with the light.

3. The test apparatus according to claim 1, wherein the determination unit is configured to determine at least one cell including at least one light emitting device in which the measured photoelectric signal is out of a normal range, among the plurality of cells, as defective.

4. The test apparatus according to claim 2, wherein the determination unit is configured to determine at least one cell including at least one light emitting device in which the measured photoelectric signal is out of a normal range, among the plurality of cells, as defective.

5. The test apparatus according to claim 3, wherein the determination unit is configured to use, as the normal range, a range based on a statistic corresponding to the photoelectric signal output by each of the plurality of light emitting devices.

6. The test apparatus according to claim 4, wherein the determination unit is configured to use, as the normal range, a range based on a statistic corresponding to the photoelectric signal output by each of the plurality of light emitting devices.

7. The test apparatus according to claim 5, wherein the determination unit is configured to use the normal range different for each emission color of the light emitting device.

8. The test apparatus according to claim 6, wherein the determination unit is configured to use the normal range different for each emission color of the light emitting device.

9. The test apparatus according to claim 7, wherein a plurality of concolorous light emitting devices that emit a same color with each other are mutually connected in the plurality of cells arranged in the column direction, and the determination unit is configured to use an average current amount and a standard deviation of the photoelectric signals measured for the plurality of concolorous light emitting devices connected to each other.

10. The test apparatus according to claim 8, wherein a plurality of concolorous light emitting devices that emit a same color with each other are mutually connected in the plurality of cells arranged in the column direction, and the determination unit is configured to use an average current amount and a standard deviation of the photoelectric signals measured for the plurality of concolorous light emitting devices connected to each other.

11. The test apparatus according to claim 7, wherein a plurality of concolorous light emitting devices that emit a same color with each other are mutually connected in the plurality of cells arranged in the column direction, and the determination unit is configured to use an average current amount and a standard deviation of the photoelectric signal measured for each of a plurality of concolorous units obtained by dividing, into two or more light emitting devices, the plurality of concolorous light emitting devices connected to each other.

12. The test apparatus according to claim 8, wherein a plurality of concolorous light emitting devices that emit a same color with each other are mutually connected in the plurality of cells arranged in the column direction, and the determination unit is configured to use an average current amount and a standard deviation of the photoelectric signal measured for each of a plurality of concolorous units obtained by dividing, into two or more light emitting devices, the plurality of concolorous light emitting devices connected to each other.

13. A test method comprising:

electrically connecting an electrical connection unit to a light emitting device panel having a plurality of cells each including a light emitting device and arranged in a row direction and a column direction;

collectively irradiating the plurality of cells with light;

reading, for each row of the light emitting device panel, a photoelectric signal obtained by photoelectrically converting the light in each of two or more of the cells arranged in the column direction by the light emitting device;

measuring a photoelectric signal read from each of the plurality of cells; and determining a quality of each of the plurality of cells on a basis of a measurement result of the measuring.

14. A computer-readable storage medium having stored thereon a program that is executed by a test apparatus that tests a light emitting device panel having a plurality of cells each including a light emitting device, the program causing the test apparatus to execute:

electrically connecting an electrical connection unit to a light emitting device panel having a plurality of cells each including a light emitting device and arranged in a row direction and a column direction;

collectively irradiating the plurality of cells with light;

reading, for each row of the light emitting device panel, a photoelectric signal obtained by photoelectrically converting the light in each of two or more of the cells arranged in the column direction by the light emitting device;

measuring a photoelectric signal read from each of the plurality of cells; and determining a quality of each of the plurality of cells on a basis of a measurement result of the measuring.

* * * * *